US006481661B1

(12) United States Patent
Lauhde

(10) Patent No.: US 6,481,661 B1
(45) Date of Patent: Nov. 19, 2002

(54) ARRANGEMENT FOR WINDING CABLES OR THE LIKE

(75) Inventor: Mika Lauhde, Vantaa (FI)

(73) Assignee: Nextrom Holding S.A., Ecublens (CH)

( * ) Notice: Subject to any disclaimer, the term of this patent is extended or adjusted under 35 U.S.C. 154(b) by 0 days.

(21) Appl. No.: 09/830,712

(22) PCT Filed: Nov. 11, 1999

(86) PCT No.: PCT/FI99/00937

§ 371 (c)(1),
(2), (4) Date: May 24, 2001

(87) PCT Pub. No.: WO00/29316

PCT Pub. Date: May 25, 2000

(30) Foreign Application Priority Data

Nov. 12, 1998 (FI) ..... 982453

(51) Int. Cl.[7] ..... B65H 75/44

(52) U.S. Cl. ..... 242/399.1; 242/399.2; 242/578.3; 242/596.1; 242/596.4

(58) Field of Search ..... 242/399.1, 399.2, 242/592, 596.1, 596.7, 596.4, 578, 578.1, 578.3

(56) References Cited

U.S. PATENT DOCUMENTS 5,123,602 A 6/1992 Skalleberg et al.
5,242,127 A 9/1993 Jaaskelainen
5,333,809 A 8/1994 Berry, III et al.
5,425,511 A 6/1995 Pepe

FOREIGN PATENT DOCUMENTS

DE 2713866 C2 10/1977
WO WO 92/03367 A1 3/1992

*Primary Examiner*—John Q. Nguyen
(74) *Attorney, Agent, or Firm*—Oliff & Berridge, PLC

(57) ABSTRACT

The invention relates to an arrangement for winding a cable or the like on and off a reel with a center hole, which arrangement comprises two movable, substantially vertical support arms (1), which are supported by a frame structure and the free arm ends of which are provided with spindles (2) arranged to be inserted to the center holes of the reel (3) between the support arms, when the support arms (1) are being moved towards one another, whereby the reel can be raised from the foundation by means of vertical adjustment of the support arms (1) to enable the winding. To achieve a simple structure, the spindles (2) are arranged floatably to the ends of the support arms (1) allowing the spindles (2) to move freely in different directions. As a result of the support arms moving towards one another and resting against the center hole of the reel (3), the spindles (2) are arranged to move axially with respect to the support arms (1) into a position in which the spindles (2) are locked to the support arms (1).

7 Claims, 2 Drawing Sheets

ARRANGEMENT FOR WINDING CABLES OR THE LIKE

The invention relates to an arrangement for winding a cable or the like on and off a reel with a centre hole, which arrangement comprises two movable, substantially vertical support arms, which are supported by a frame structure and the free arm ends of which are provided with spindles arranged to be inserted to the centre holes of the reel between the support arms, when the support arms are moved towards one another, whereby the reel can be raised from the foundation by means of vertical adjustment to enable the winding.

Such arrangements are well known from situations in which various flexible elongated products are handled. The above arrangements have especially been used in cable manufacture, and the solutions disclosed in the German Patent 27 13 866 (the Finnish Publication 60542) and the U.S. Pat. Nos. 5,123,602 and 5,242,127 can be cited as examples thereof.

It is difficult to position the reel into the winder in practice, because guiding of the spindles into the centre hole of the reel is not easy. To solve this problem, a variety of solutions has been developed, and they have been described in the above-mentioned publications, for example.

A disadvantage of the above prior art solutions is, however, their complex structure, whereby the manufacturing costs are high. A complex structure also makes great demands on installation and adjustments, and implementation and operating costs rise relatively high. Due to the complexity, a further disadvantage is that devices do not have the best possible reliability, and there is a big risk of malfunctions partly because the solutions are relatively sensitive with respect to adjustments, as mentioned above.

It is an object of the invention to provide an arrangement to eliminate the prior art disadvantages. This is achieved by the arrangement of the invention. The arrangement of the invention is characterized in that the spinles are arranged floatably to the ends of the support arms making the spindles move freely in different directions, and that as a result of the support arms moving towards one another and resting against the centre hole of the reel, the spindles are arranged to move axially with respect to the support arms into a position in which the spindles are locked to the support arms.

A particular advantage of the invention is its simplicity, whereby the implementation and operating costs of the invention are kept low. Another advantage is the reliability of the arrangement. Further, a substantial advantage is that the arrangement of the invention can be implemented largely by using the same parts as in normal fixed spindles. The invention provides also the advantage that the arrangement of the invention can be applied to various winders and it can further be applied to already existing winders without having to make big structural changes.

Figure 1:
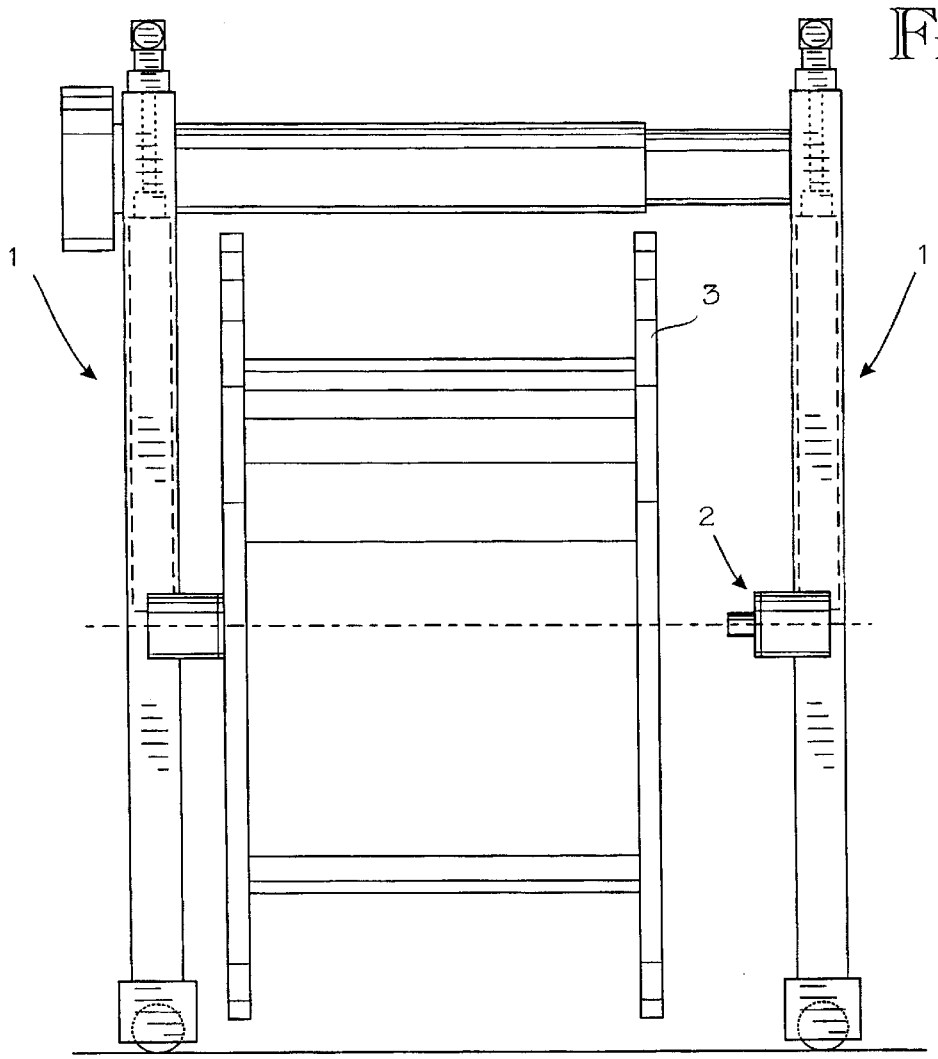
Figure 2:
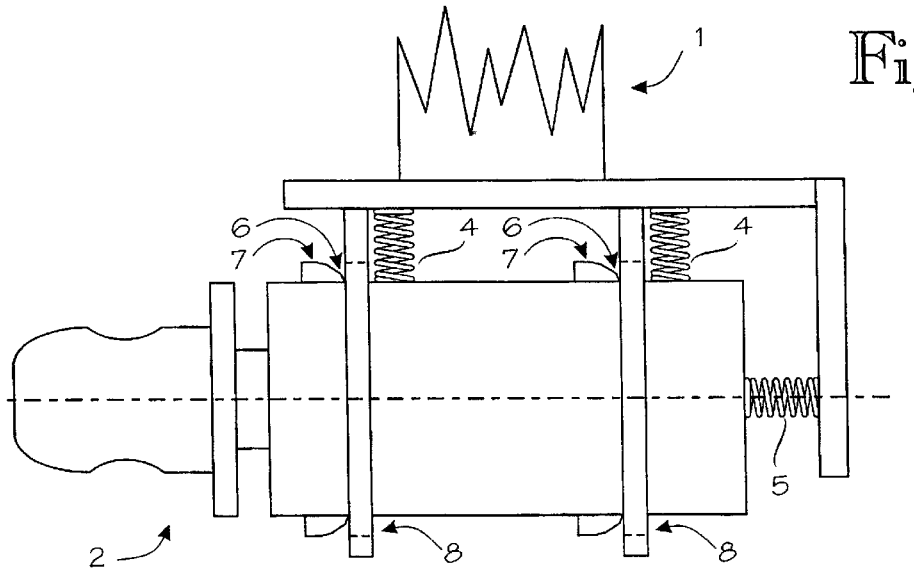
Figure 3:
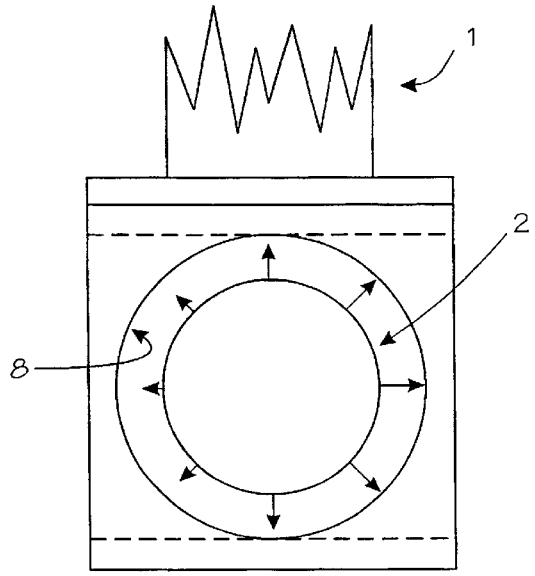
Figure 4:
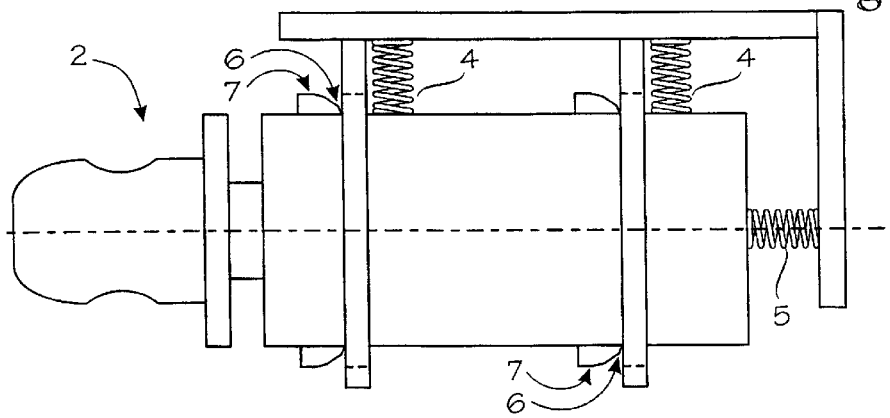
Figure 5:
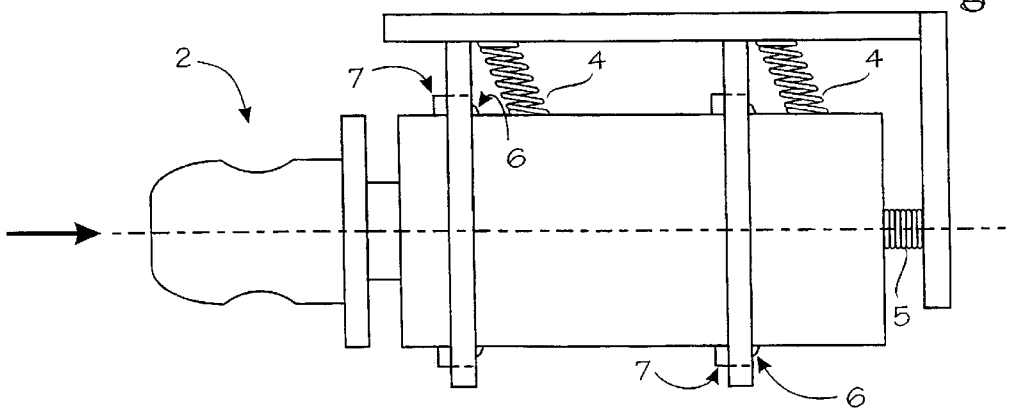

In the following the invention will be described in greater detail by means of a preferred embodiment illustrated in the attached drawing, in which FIG. 1 shows a schematic view of a winder, to which the invention can be applied, FIG. 2 shows a schematic side view of the arrangement of the invention, FIG. 3 shows the arrangement of FIG. 2 seen in the direction of the symmetry axis of the spindle, FIG. 4 shows a schematic side view of the arrangement of the invention in a situation in which the spindle can move freely, and FIG. 5 shows a schematic side view of the arrangement of the invention in a situation in which the spindle is locked to the support arm.

FIG. 1 shows a schematic view of a winder. The winder comprises two movable support arms 1, which are substantially adjusted in the vertical direction. The support arms 1 are arranged to be supported by the frame structure in such a manner that they can be moved vertically and horizontally. Spindles 2 are arranged to the free ends of the support arms 1, which spindles are arranged to be inserted to the centre hole of the reel 3 between the support arms 1, when the support arms are moved horizontally towards one another. When both spindles are in the centre hole of the reel, the reel can be lifted from its foundation by raising the support arms vertically. When the reel is supported by the spindles, it can be rotated in the desired direction depending on whether the cable or the like is wound on or off the reel.

The structure and operation of the winder constitute fully conventional technology for a person skilled in the art, wherefore the above factors will not be described in greater detail herein.

FIGS. 2 and 3 show the arrangement of the invention schematically. In FIG. 2 same reference numbers as in FIG. 1 are used to refer to the corresponding items. As FIG. 2 shows, the spindle 2 is arranged in a freely floatable manner to the ends of the support arms 1. The wording 'floatable' means that the spindle 2 can move freely in different directions, i.e. in all degrees of freedom. On account of this fact, the spindles in a sense find their way to the centre hole of the reel 3 easier than before when the support arms 1 are moved towards one another, i.e. when the aim is to catch hold of the reel 3 and lift it up for winding.

The spindle 2 can be arranged to the support arm 1 e.g. by means of spring means 4 and 5 functioning radially and axially with respect to the spindle, as shown e.g. in FIG. 2. The floatable support of the spindle allows it to move axially when the spindles are supported by the centre hole of the reel and the support arms are moved further towards one another. The invention utilizes this factor as will be described in the following.

As FIG. 2 shows, the spindle 2 is provided with guiding surfaces 6 and supporting lock surfaces 7. A guiding surface 6 is preferably a conical surface and a supporting lock surface correspondingly a surface parallel to the symmetry axis of the spindle. The above-mentioned surfaces can preferably be implemented by projecting parts on the outer surface of the spindle, as in the example of the figure. The number of the above-mentioned surfaces may vary, when necessary. A surface 8 co-operating with the guiding surface 6 and the supporting lock surface 7 is arranged to the support arm 1, the surface 8 being arranged to come into contact with the above-mentioned surfaces 6 and when the spindle moves axially with respect to the support arm, as described above. The surface 8 can be seen particularly well in FIG. 3, which shows that the surface in question is composed of a hole, through which the spindle extends. The example of the figure includes two surfaces 8, but the number of surfaces may naturally vary, when necessary.

FIGS. 4 and 5 show the axial movement of the spindle, whereby the spindle is supported by the centre hole of the reel and the support arms are moved further towards one another. In FIG. 4 the spindle is in a free state, and in FIG. 5 the spindle moves axially with respect to the support arm, as described above. As a result of this movement, the guiding surface 6 and the co-operating surface 8 in the support arm 1 come into contact, and if the movement continues, the spindle is funnelled into a position in which the spindle is locked by means of the supporting lock surface 7 and the cooperating surface 8 to the support arm 1. In FIG. 5 the spindle is rigidly locked to the support arm, and the reel can be lifted by raising the support arms 1.

The above embodiment is not intended to restrict the invention in any way, but the invention may be modified quite freely within the scope of the claims. Therefore it is obvious that the invention or the details thereof do not have to be exactly identical to those shown in the figures, but also other solutions are possible. For example, the spring means naturally need not be the elements described in the figures, but other types of elements can also be used for achieving the free floatability of the spindle. Spring means can be e.g. suitable rubber elements or the like. Although the invention has been described above in connection with cable winding, it is obvious that the invention is not restricted solely to cable winding, but it may also be used in connection with other similar flexible elongated products, e.g. ropes, wires, yarns and tubes.

What is claimed is:

1. An arrangement for winding a cable on and off a reel with a centre hole, which arrangement comprises two movable, substantially vertical support arms (1), which are supported by a frame structure and the free arm ends of which are provided with spindles (2) arranged to be inserted to the centre hole of the reel (3) between the support arms, when the support arms (1) are moved towards one another, whereby the reel can be raised from the foundation by means of vertical adjustment of the support arms (1) to enable the winding, characterized in that the spindles (2) are arranged floatably to the ends of the support arms (1) enabling the spindles to (2) move freely in different directions and as a result of the support arms moving towards one another and resting against the centre hole of the reel (3), the spindles (2) are arranged to move axially with respect to the support arms (1) into a position in which the spindles (2) are locked to the support arms (1).

2. An arrangement as claimed in claim 1, characterized in that the spindles (2) are arranged to the support arms (1) by means of spring means (4, 5) functioning to floatably support the spindles in the radial and axial directions.

3. An arrangement as claimed in claim 2, characterized in that each spindle (2) is provided with at least one guiding surface (6) and at least one supporting lock surface (7) and that a surface (8) co-operating with the guiding surface (6) and the supporting lock surface (7) is arranged to the support arm (1), whereby as a result of the axial movement of the spindle (2) the guiding surface (6) and the co-operating surface (8) are arranged to come into contact with one another and to bring the spindle (2) into a position in which the spindle (2) is locked by means of the supporting lock surface (7) and the co-operating surface (8) in the support arm to the support arm (1).

4. An arrangement as claimed in claim 1, characterized in that each spindle (2) is provided with at least one guiding surface (6) and at least one supporting lock surface (7) and that a surface (8) co-operating with the guiding surface (6) and the supporting lock surface (7) is arranged to the support arm (1), whereby as a result of the axial movement of the spindle (2) the guiding surface (6) and the co-operating surface (8) are arranged to come into contact with one another and to bring the spindle (2) into a position in which the spindle (2) is locked by means of the supporting lock surface (7) and the co-operating surface (8) in the support arm to the support arm (1).

5. An arrangement as claimed in claim 4, characterized in that the supporting lock surface (7) is parallel to the symmetry axis of the spindle.

6. An arrangement as claimed in claim 4, characterized in that the guiding surface (6) is a conical surface.

7. An arrangement as claimed in claim 4, characterized in that the supporting lock surface (7) is parallel to the symmetry axis of the spindle.

* * * * *